US011129486B2

(12) United States Patent
Sutton et al.

(10) Patent No.: US 11,129,486 B2
(45) Date of Patent: Sep. 28, 2021

(54) COMBINATION PILLOW AND SLEEPING BAG OR BLANKET OR COMFORTER

(71) Applicant: Jay At Play International Hong Kong Limited, Kowloon (HK)

(72) Inventors: Joseph A. Sutton, Delray Beach, FL (US); William Ward, Ravenel, SC (US)

(73) Assignee: Jay at Play International Hong Kong Limited, Kowloon (HK)

( * ) Notice: Subject to any disclaimer, the term of this patent is extended or adjusted under 35 U.S.C. 154(b) by 0 days.

(21) Appl. No.: 17/066,889

(22) Filed: Oct. 9, 2020

(65) Prior Publication Data

US 2021/0106155 A1 Apr. 15, 2021

Related U.S. Application Data

(60) Provisional application No. 62/935,239, filed on Nov. 14, 2019, provisional application No. 62/714,173, filed on Oct. 11, 2019.

(51) Int. Cl.
*A47G 9/08* (2006.01)
*A47G 9/10* (2006.01)

(52) U.S. Cl.
CPC ..... *A47G 9/083* (2013.01); *A47G 9/1045* (2013.01); *A47G 2009/1018* (2013.01)

(58) Field of Classification Search
CPC ..... A47G 9/083; A47G 9/1045; A47G 2009/1018; A47G 9/08; A47G 9/066
See application file for complete search history.

(56) References Cited

U.S. PATENT DOCUMENTS

| | | | |
|---|---|---|---|
| 197,346 | A | 11/1877 | Denneler |
| 766,613 | A | 8/1904 | Greene |
| 1,670,405 | A | 5/1928 | Green |
| 2,213,754 | A | 9/1940 | Thirring |
| 3,013,797 | A | 12/1961 | Schwartz |
| 4,316,288 | A | 2/1982 | Henrickson |

(Continued)

OTHER PUBLICATIONS

International Search Report and Written Opinion for Application No. PCT/US2020/054962 dated Jan. 29, 2021 (23 pages).

(Continued)

*Primary Examiner* — Eric J Kurilla
(74) *Attorney, Agent, or Firm* — Michael Best & Friedrich LLP

(57) ABSTRACT

A combination pillow and sleeping bag is described. The combination pillow and sleeping bag is configurable between a first configuration and a second configuration. The combination pillow and sleeping bag includes a first pillow portion and a second pillow portion detachably coupled to the first pillow portion. The second pillow portion defines a cavity. The combination pillow and sleeping bag also includes a sleeping bag having a first end coupled to the first pillow portion and a second end coupled to the second pillow portion. When in the first configuration, the first and second pillow portions are coupled together and the sleeping bag is positioned within the cavity of the second pillow portion. When in the second configuration, the first and second pillow portions are detached from one another and spaced apart such that the sleeping bag extends between the first and second pillow portions.

18 Claims, 19 Drawing Sheets

(56) References Cited

U.S. PATENT DOCUMENTS

| | | | | |
|---|---|---|---|---|
| 4,543,669 | A | 10/1985 | Katz | |
| 4,590,633 | A | 5/1986 | Pickens | |
| 4,754,512 | A | 7/1988 | Chao-Yang | |
| 4,774,734 | A | 10/1988 | Mills | |
| 4,856,131 | A | 8/1989 | Mills | |
| D328,665 | S | 8/1992 | McNaughton | |
| 5,172,440 | A | 12/1992 | Ming | |
| 5,226,193 | A * | 7/1993 | Chen | A41B 13/06 2/69 |
| D361,686 | S | 8/1995 | Stearns | |
| 5,638,561 | A * | 6/1997 | Sperry | A41B 13/06 446/72 |
| 6,343,968 | B1 | 2/2002 | Louie et al. | |
| 6,370,692 | B1 | 4/2002 | Duyn et al. | |
| 6,421,852 | B1 | 7/2002 | Shao | |
| 6,427,267 | B1 | 8/2002 | Turner | |
| 6,536,049 | B2 | 3/2003 | Jastrab et al. | |
| 7,058,997 | B1 | 6/2006 | Klinger | |
| 7,222,371 | B2 | 5/2007 | Houghton et al. | |
| 7,367,070 | B2 | 5/2008 | Akkad | |
| 8,468,612 | B1 | 6/2013 | Galloway | |
| 8,485,596 | B1 | 7/2013 | Martin | |
| 8,864,544 | B2 | 10/2014 | Anderman et al. | |
| 9,095,240 | B2 | 8/2015 | Bowen | |
| 9,155,341 | B2 | 10/2015 | Czarnik | |
| 9,775,388 | B2 | 10/2017 | Czarnik | |
| D811,695 | S | 3/2018 | Mangnall-Schwarz | |
| 10,265,636 | B2 | 4/2019 | Anderman et al. | |
| 10,477,906 | B2 | 11/2019 | Mangnall-Schwarz | |
| 2001/0044964 | A1 | 11/2001 | Phillips | |
| 2005/0172401 | A1* | 8/2005 | Akkad | A47D 11/00 5/413 R |
| 2006/0207024 | A1* | 9/2006 | Korshamn | A47G 9/08 5/413 R |
| 2010/0146680 | A1 | 6/2010 | Cuoco | |
| 2010/0205714 | A1 | 8/2010 | Pollack | |
| 2012/0005801 | A1 | 1/2012 | Parr | |
| 2013/0171906 | A1* | 7/2013 | Smoot | A47G 9/0207 446/73 |
| 2013/0189898 | A1* | 7/2013 | Abbott | A47G 9/0207 446/73 |
| 2018/0007981 | A1 | 1/2018 | Czarnik | |
| 2018/0064269 | A1* | 3/2018 | Carlile | A47G 9/066 |
| 2018/0352879 | A1* | 12/2018 | Goulina | A41D 11/00 |
| 2019/0076745 | A1* | 3/2019 | Sapulich | A47G 9/0223 |
| 2020/0077819 | A1* | 3/2020 | Thibodeau | A41D 15/04 |

OTHER PUBLICATIONS

Ross-Simons, "Child's Hippo Plush Sleeping Bag," <https://www.ross-simons.com/childs-hippo-plush-sleeping-bag-872023.html?cjevent=fc79bd40dfde11e9835a00220a24060e&utm_campaign=13687121&utm_medium=affiliate&utm_source=8280252> web page first accessed Sep. 25, 2019.

Pottery Barn Kids, "Puppy Pillow Pal Sleeping Bag," <https://www.potterybarnkids.com/products/puppy-pillow-pal-sleeping-bag/?catalogId=10&sku=3664614&cm_ven=PLA&cm_cat=MSN&cm_pla=Bedding%20%3E%20Sleeping%20Bags%20%26%20Nap%20Mats&msclkid=c223b9d116321cc958f7e45dd1028241&adlclid=ADL-506b57c1-3bb5-4da5-bd99-2d6254c0d7bd> web page first accessed Sep. 25, 2019.

Costco, "Hugfun Kids Animal Slumber Bag," <https://www.costco.com/hugfun-kids-animal-slumber-bag.product.100591769.html> web page first accessed Jul. 2020.

* cited by examiner

COMBINATION PILLOW AND SLEEPING BAG OR BLANKET OR COMFORTER

CROSS-REFERENCE TO RELATED APPLICATIONS

This application claims the benefit of U.S. Provisional Patent Application No. 62/914,173, filed on Oct. 11, 2019, and U.S. Provisional Patent Application No. 62/935,239, filed on Nov. 14, 2019.

FIELD

The present invention relates to a convertible pillow, and more particularly to a pillow that converts to a sleeping bag, and/or a blanket, and/or a comforter with an attached pillow.

SUMMARY

In one aspect, a combination pillow and sleeping bag is configurable between a first configuration and a second configuration. The combination pillow and sleeping bag includes a first pillow portion and a second pillow portion detachably coupled to the first pillow portion. The second pillow portion defines a cavity. The combination pillow and sleeping bag also includes a sleeping bag having a first end coupled to the first pillow portion and a second end coupled to the second pillow portion. When in the first configuration, the first and second pillow portions are coupled together, and the sleeping bag is positioned within the cavity of the second pillow portion. When in the second configuration, the first and second pillow portions are detached from one another and spaced apart such that the sleeping bag extends between the first and second pillow portions.

In another aspect, a combination pillow and sleeping bag is configurable between a first configuration and a second configuration. The combination pillow and sleeping bag includes a first pillow portion containing a stuffing material that gives the first pillow portion a generally fixed shape, a second pillow portion detachably coupled to the first pillow portion, the second pillow portion defining a cavity, a fastener on one of the first or second pillow portions for detachably coupling the first and second pillow portions together, and a sleeping bag having a first end coupled to the first pillow portion and a second end coupled to the second pillow portion. When in the first configuration, the first and second pillow portions are detachably coupled together by the fastener with the sleeping bag positioned within the cavity of the second pillow portion, the sleeping bag acting as stuffing material for the second pillow portion, where the sleeping bag positioned within the cavity of the second pillow portion gives the second pillow portion a generally fixed shape. When in the second configuration, the first and second pillow portions are detached from one another and spaced apart such that the sleeping bag extends between the first and second pillow portions, the second end of the sleeping bag being coupled to the second pillow portion around an entire perimeter of the second end of the sleeping bag such that the second pillow portion cooperates with the sleeping bag to form a closed end, and the sleeping bag is coupled to the first pillow portion around less than an entire perimeter of the first end of the sleeping bag such that an unattached portion of the first end of the sleeping bag forms an opening of the sleeping bag in the second configuration.

In yet another aspect, a combination pillow and blanket is configurable between a first configuration and a second configuration. The combination pillow and blanket includes a first pillow portion, a second pillow portion detachably coupled to the first pillow portion, the second pillow portion defining a cavity, and a blanket having four edges. A section of the first edge of the blanket is coupled to the first pillow portion and a section of the second edge of the blanket is coupled to the second pillow portion. The third and fourth edges are configured to fold over one another to wrap around a user. In the first configuration, the first and second pillow portions are coupled together and the blanket is positioned within the cavity of the second pillow portion. In the second configuration, the first and second pillow portions are detached from one another and spaced apart such that the blanket extends between the first and second pillow portions.

In still another aspect, a combination pillow and blanket is configurable between a first configuration and a second configuration. The combination pillow and blanket includes a first portion and a second portion detachably coupled to the first portion. The first portion defines a cavity. The combination pillow and blanket also includes a blanket having a perimeter. A section of the perimeter of the blanket is coupled to the first portion. Another section of the perimeter of the blanket is able to fold over the blanket to wrap around a user. In the first configuration, the first and second portions are coupled together and the blanket is positioned within the cavity of the first portion. In the second configuration, the first and second portions are detached from one another and spaced apart such that at least a portion of the blanket extends between the first and second portions, and the first portion is configured to function as a hood.

In another aspect, a combination pillow and comforter is configurable between a first configuration and a second configuration. The combination pillow and comforter includes a first pillow portion and a second pillow portion detachably coupled to the first pillow portion, where the second pillow portion defines a cavity. A comforter is attached to a portion of each of the first and second pillow portions. The comforter is able to fit over a mattress. In the first configuration, the first and second pillow portions are coupled together and the comforter is positioned within the cavity of the second pillow portion. In the second configuration, the first and second pillow portions are detached from one another and spaced apart and adjacent opposing ends of the comforter.

A method of transforming a combination pillow and sleeping bag includes disconnecting one or more fasteners connecting a first pillow portion to a second pillow portion, and moving the first pillow portion away from the second pillow portion until a sleeping bag is fully extended between the two pillow portions to transform the combination pillow and sleeping bag from a first configuration to a second configuration.

Other features and aspects of the invention will become apparent by consideration of the following detailed description and accompanying drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Figure 1:
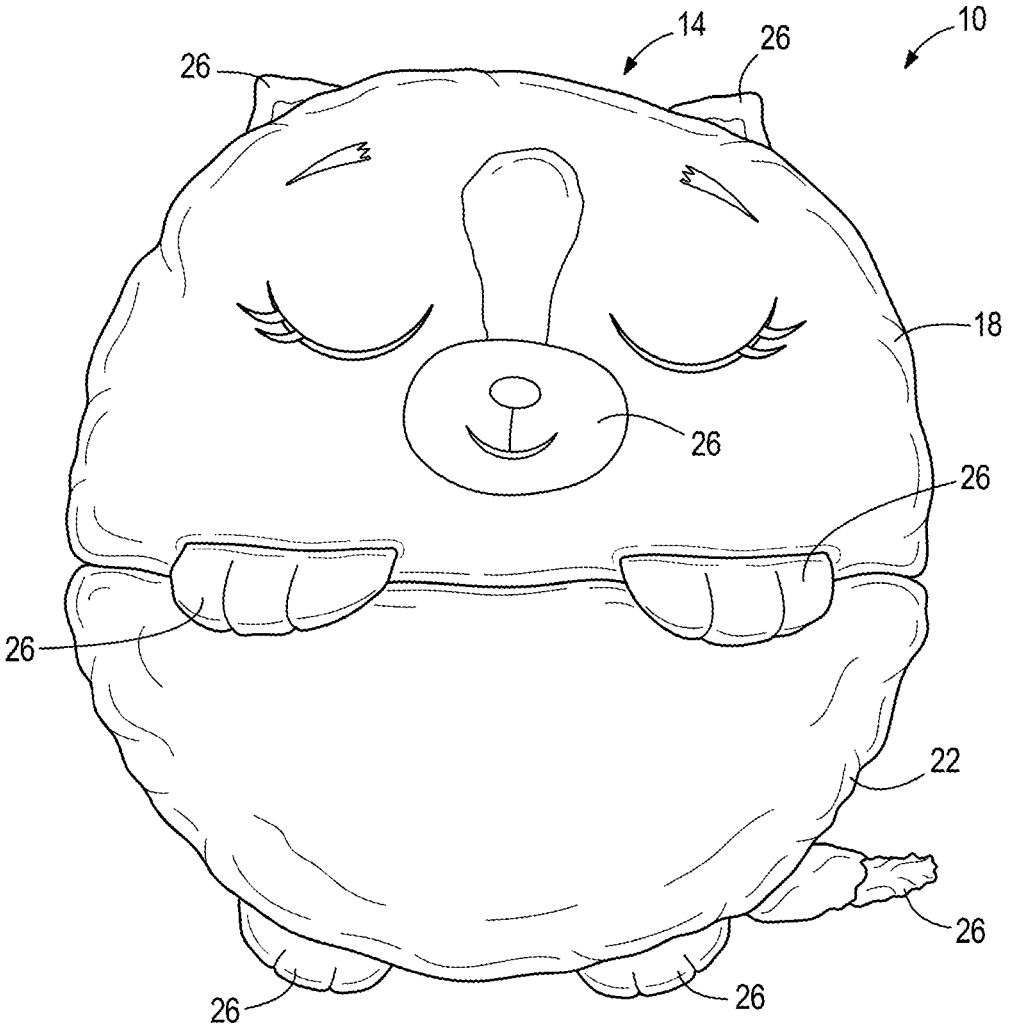
FIG. 1 depicts a front view of an example combination pillow and sleeping bag in a first configuration.
Figure 2:
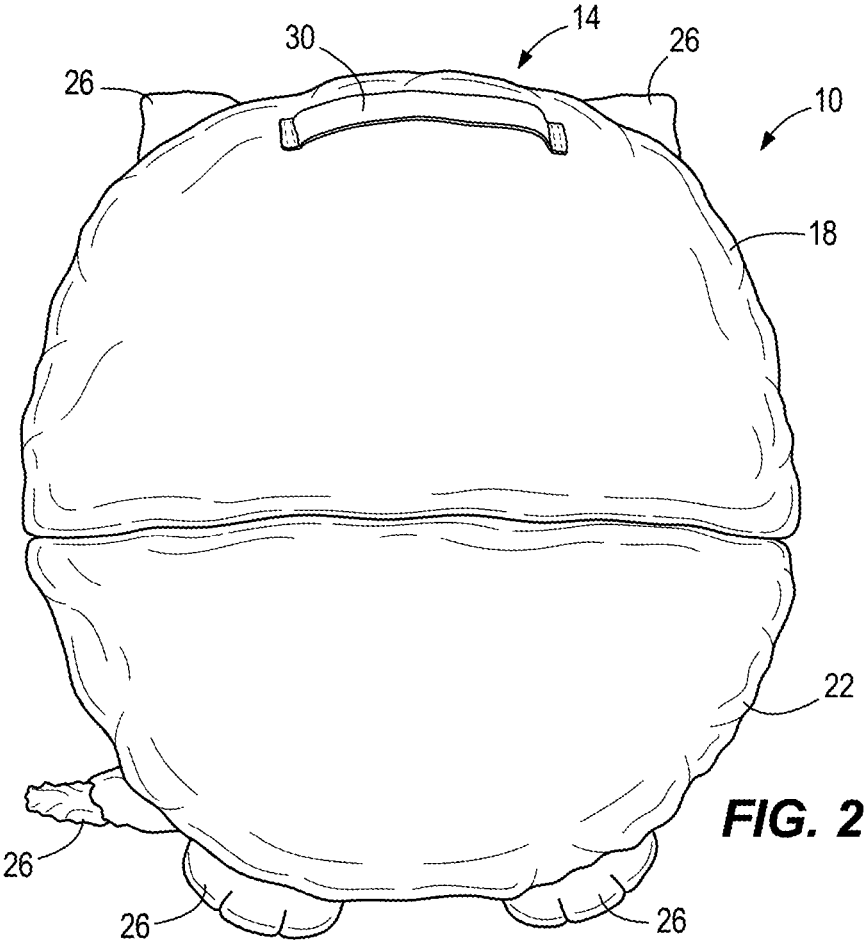
FIG. 2 depicts a rear view of the example combination pillow and sleeping bag of FIG. 1 in the first configuration.

An example combination pillow and sleeping bag 10 that is transformable between a first configuration and a second configuration is described herein. FIGS. 1 and 2 depict the combination pillow and sleeping bag 10 in the first configuration 14, which is a pillow in this example embodiment. The pillow is formed by a first pillow portion 18 and a second pillow portion 22. In the first configuration, the first and second pillow portions 18, 22 cooperate to form a pillow having a generally continuous outer periphery. As illustrated, the continuous outer periphery of the pillow in the first configuration 14 forms a generally circularly-shaped pillow. Each of the first and second pillow portions 18, 22 are approximately the same size and shape in the first configuration 14. Alternatively, the first and second pillow portions 18, 22 may be different sizes. For example, the first pillow portion 18 may be significantly smaller or larger than (i.e., half the size of, twice the size of) the second pillow portion 22. In the illustrated example, each of the first and second pillow portions 18, 22 is generally semi-circular in shape. Alternatively, the first and second pillow portions 18, 22 may each be a different shape, such as a square, a rectangle, a triangle, etc.

An exterior of each of the first and second pillow portions 18, 22 is made from or includes a first fabric, which is generally soft or plush to the touch. The first pillow portion 18 may be filled with one of a foam, a fiber stuffing, or beans, or any other suitable filling for a pillow. The stuffing material of the first pillow portion 18 gives the first pillow portion a generally fixed shape. That is, the first pillow portion 18 does not change shape when the combination pillow and sleeping bag 10 is transformed from the first configuration 14 to a second configuration. The first pillow portion 18 serves as a pillow that may be used as a rest for a user's (e.g., a child's) head when the combination pillow and sleeping bag 10 is in both configurations. However, the shape of the first pillow portion 18 may be slightly deformed when weight is placed on the first pillow portion 18, as any pillow would be. The second pillow portion 22 forms a cavity 24 (depicted in FIG. 16) in which the sleeping bag of the combination pillow and sleeping bag 10 is positioned when the combination pillow and sleeping bag 10 is in the first configuration 14. When the sleeping bag is positioned within the cavity 24 in the first configuration 14, the sleeping bag acts as a filling material for the second pillow portion 22. The second pillow portion 22, in this first configuration 14, has a generally fixed shape that may be slightly deformed when weight is placed on the second pillow portion 22, as any other pillow would be. The illustrated cavity 24 is sized such that the inserted sleeping bag fills the cavity 24 so as to make the fixed shape of the second pillow portion 22 generally correspond to the fixed shape of the first pillow portion 18.

When in the first configuration 14, the combination pillow and sleeping bag 10 depicts a character image formed by the coupled first and second pillow portions 18, 22. The character image may be a cat, as depicted, or may be another character image. Other examples of character images include movie or television characters, animated characters, animals, humans, inanimate objects, fantasy creatures or objects, or other articles, whether real or imagined (hereinafter collectively referred to as a character image). Different character images may include but are not limited to: a ladybug, a polar bear, a dog, a wolf, a bear, a cow, a cat, a mouse, a monkey, a frog, a unicorn, a horse, a dragon, a lizard, a tiger, a giraffe, an elephant, a hippopotamus, a hedgehog, a turtle, a panda, or a rabbit. The pillow may include a number of appendages 26 attached to the first pillow portion 18 and/or the second pillow portion 22 that correspond to and further add to the likeness of the character image. Appendages 26 may include paws, ears, noses, antennae, horns, tails, etc., which correspond to the character image formed by the first and second pillow portion 18, 22. Additionally, other character image features (e.g., eyes, a nose, a mouth, etc.) may be provided on the first fabric of the first and second pillow portions 18, 22 to further convey attributes of the character image.

Figure 3:
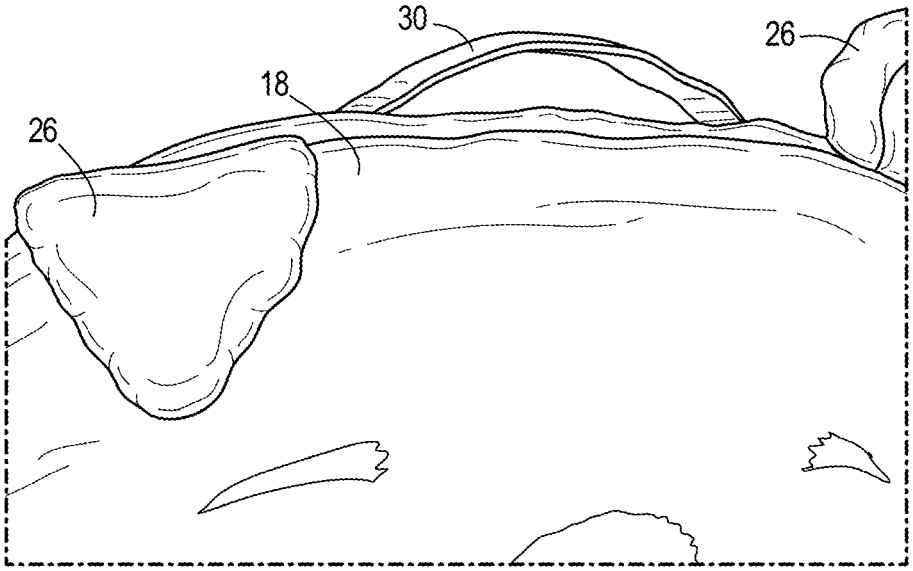
FIG. 3 depicts an example carrying strap that may be used to carry the combination pillow and sleeping bag of FIG. 1 in the first configuration.
Figure 4A:
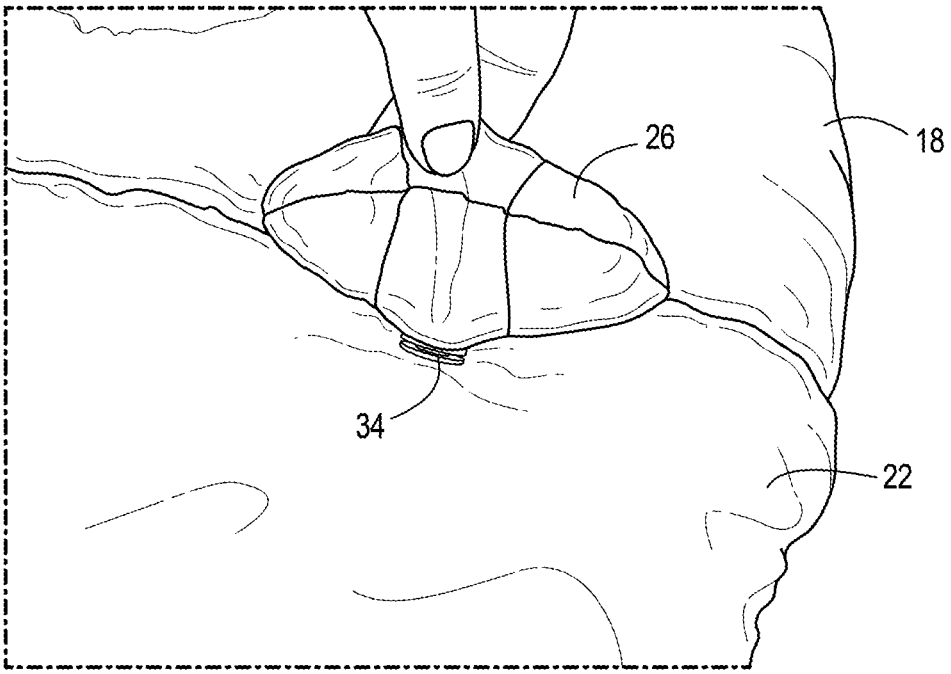
FIGS. 4A-4D depict example fasteners to connect the first and second pillow portions of the combination pillow and sleeping bag of FIG. 1.
Figure 4B:
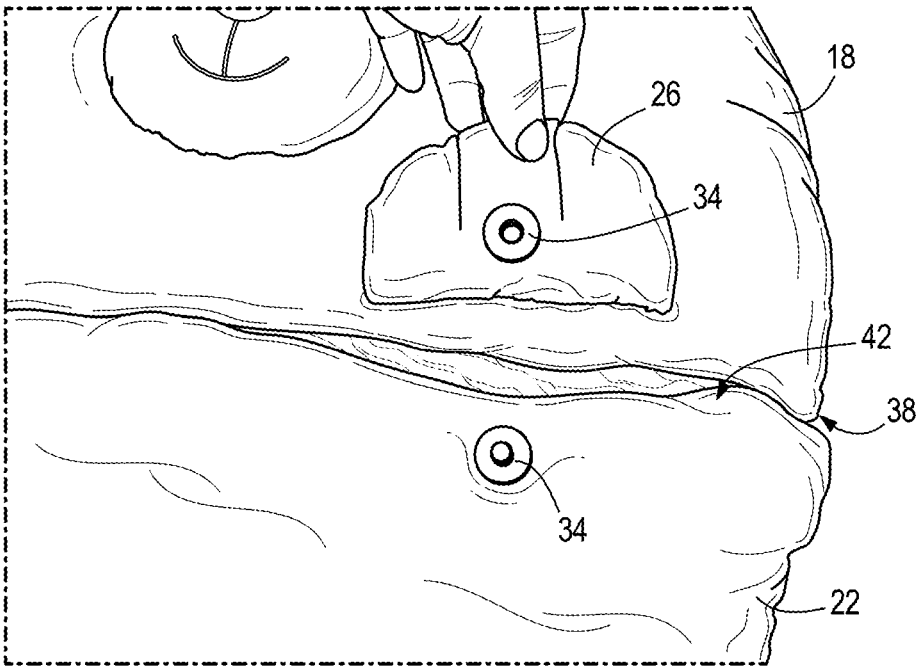
Figure 4C:
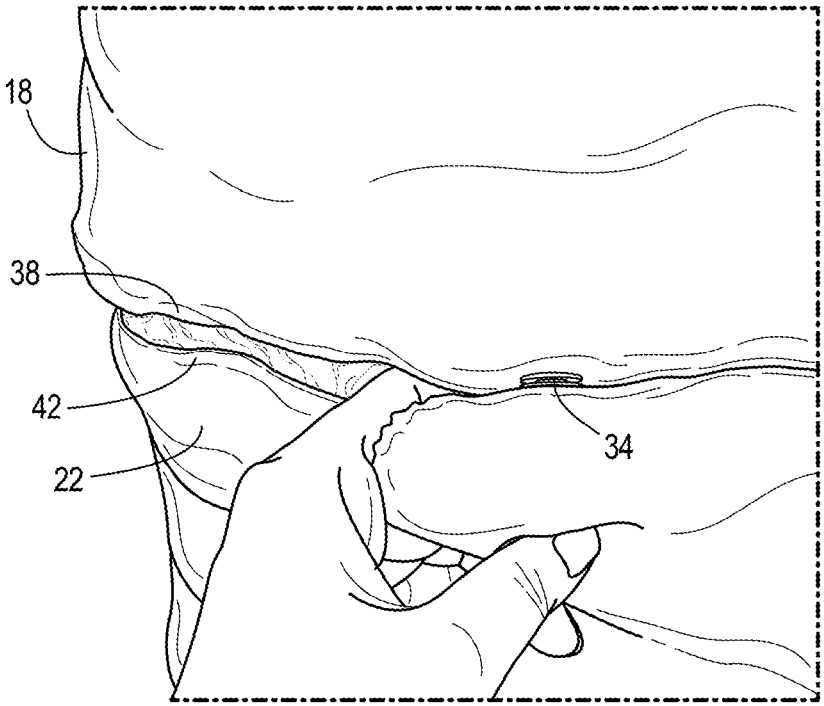
Figure 4D:
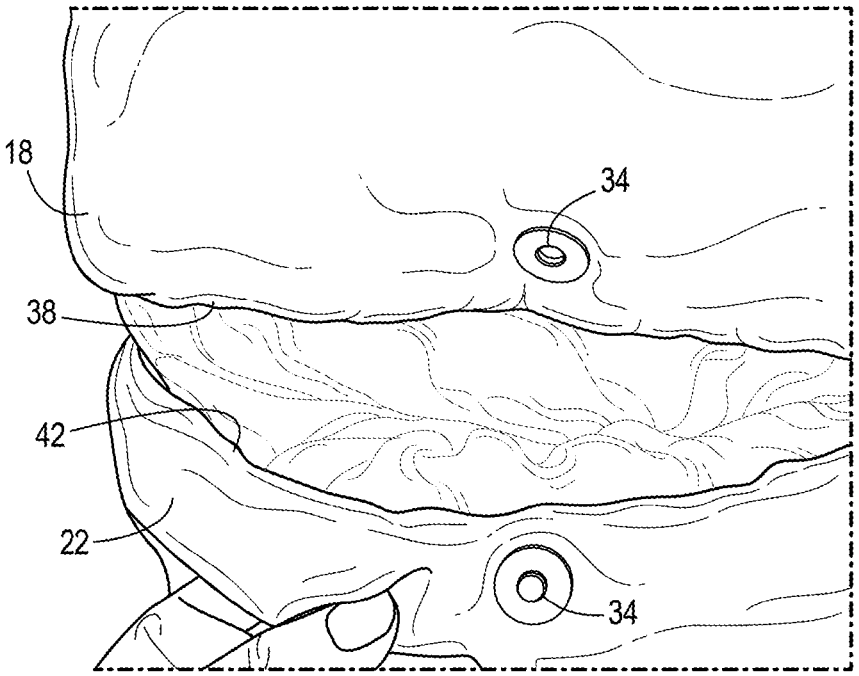
Figure 5:
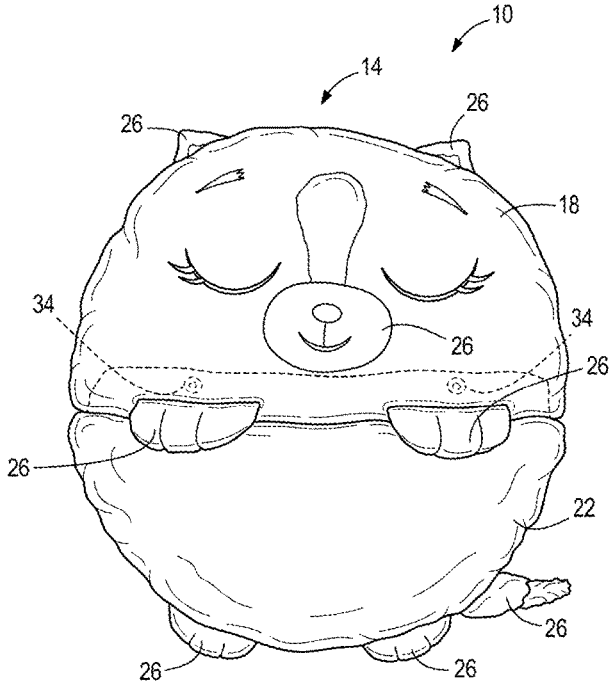
FIG. 5 depicts a front view of another example combination pillow and sleeping bag in a first configuration.
Figure 6:
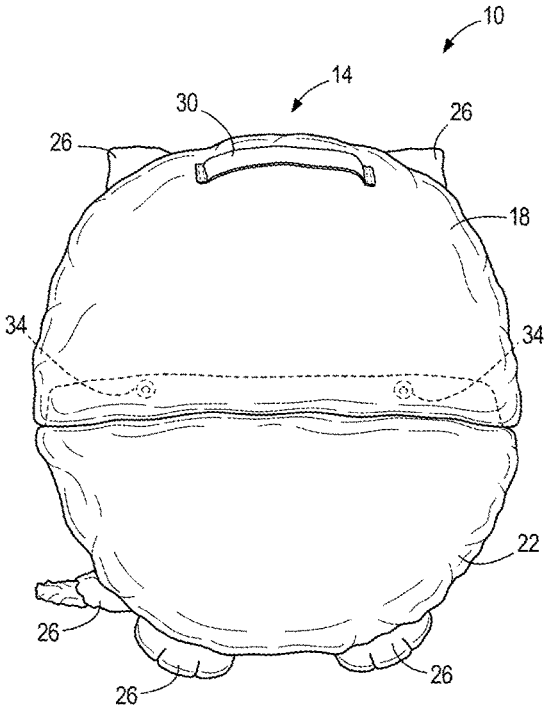
FIG. 6 depicts a rear view of the combination pillow and sleeping bag of FIG. 5.
Figure 7:
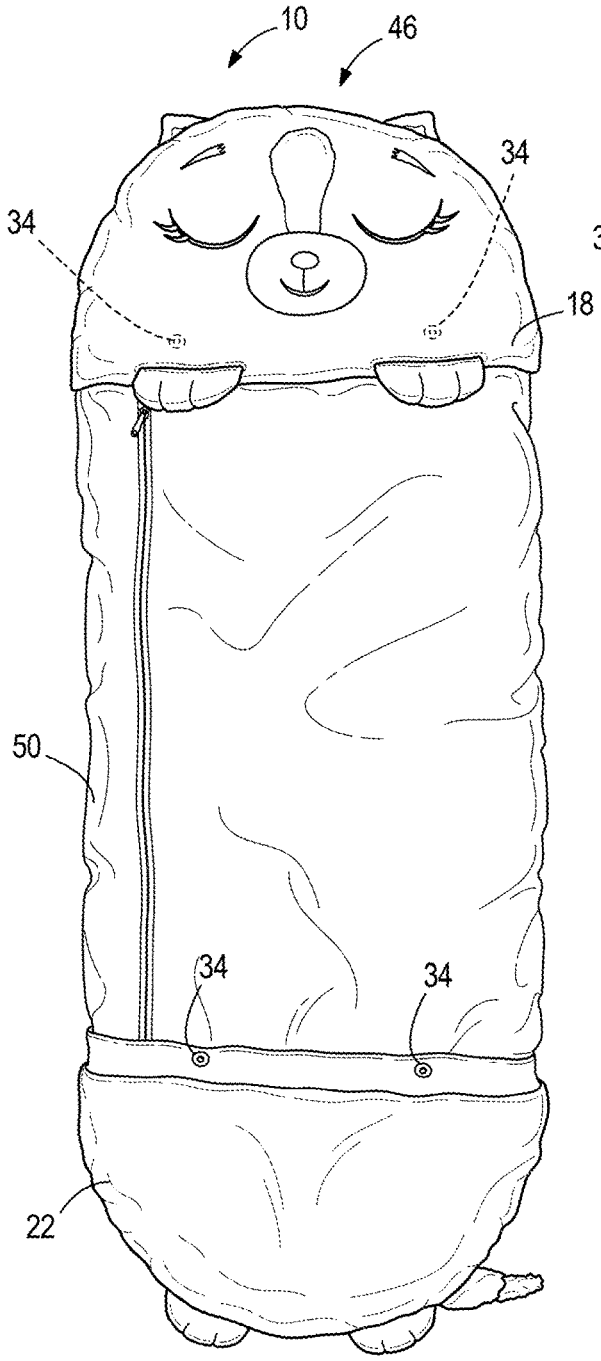
FIG. 7 depicts a front view of the combination pillow and sleeping bag of FIG. 5 in a second configuration.
Figure 8:
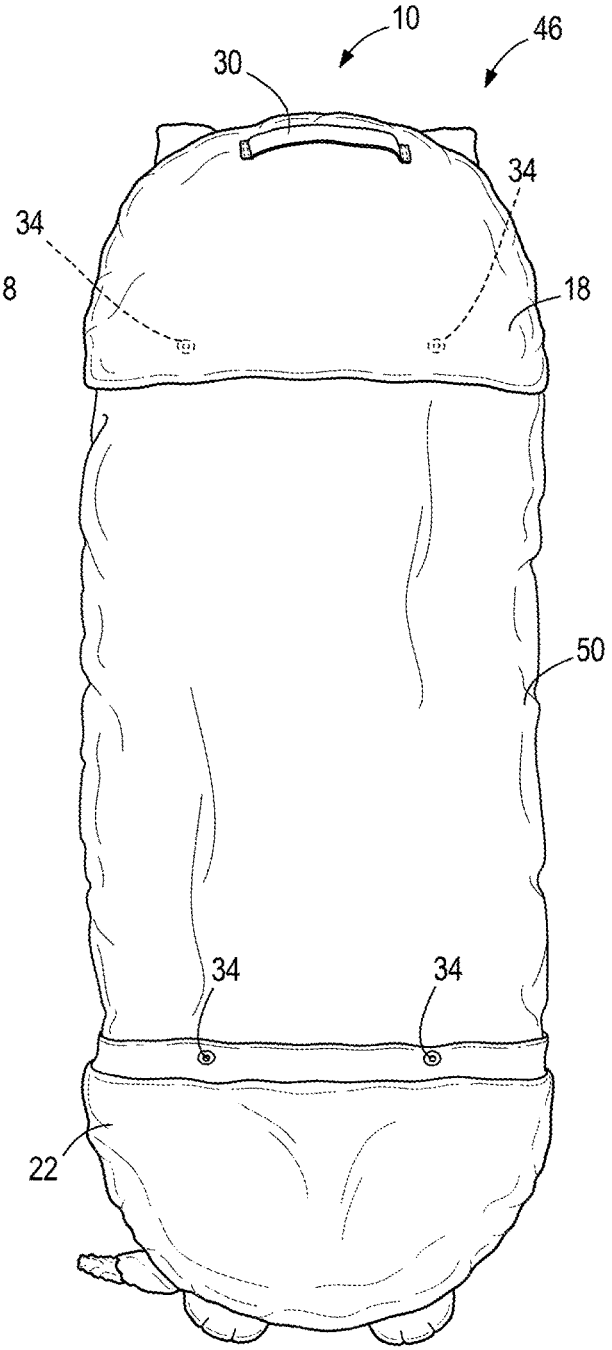
FIG. 8 depicts a rear view of the combination pillow and sleeping bag of FIG. 5 in the second configuration.

FIG. 3 depicts an example carrying strap 30 on one of the first pillow portion 18 or the second pillow portion 22. In the illustrated embodiment, the carrying strap 30 is on the first pillow portion 18. The carrying strap 30 may be used when the combination pillow and sleeping bag 10 is in the first configuration 14 to enable a user to easily carry the combination pillow and sleeping bag 10 from one location to another. The carrying strap 30 may also be used to assist in holding the first pillow portion 18 when transforming the combination pillow and sleeping bag 10 to the second configuration, as will be described below.

The second pillow portion 22 is detachably coupled to the first pillow portion 18. FIGS. 4A-4D depict example fasteners 34 that may be used to couple the first pillow portion 18 to the second pillow portion 22. In some examples, one or more of the fasteners 34 is coupled to an appendage 26 (e.g., a paw) of the character figure. In other embodiments, the fasteners 34 may be located elsewhere, such as on an inner or outer surface of each of the first and second pillow portions 18, 22. In the embodiment illustrated in FIGS. 5-8, for instance, the fasteners 34 are located on an exterior surface of the second pillow portion 22 and an interior surface of the first pillow portion 18. The fasteners 34 may be aligned such that, when coupled together, an end 38 of the first pillow portion 18 abuts and/or overlaps an end 42 of the second pillow portion 22. The fasteners 34 may be snaps, as shown, or may be any other suitable fastener, including but not limited to buttons, hook and loop material, hooks, ties, etc. The illustrated snaps 34 are magnetic snaps that have a magnetic attraction between the mating snap halves to facilitate interconnection of the snaps 34.

Figure 9:
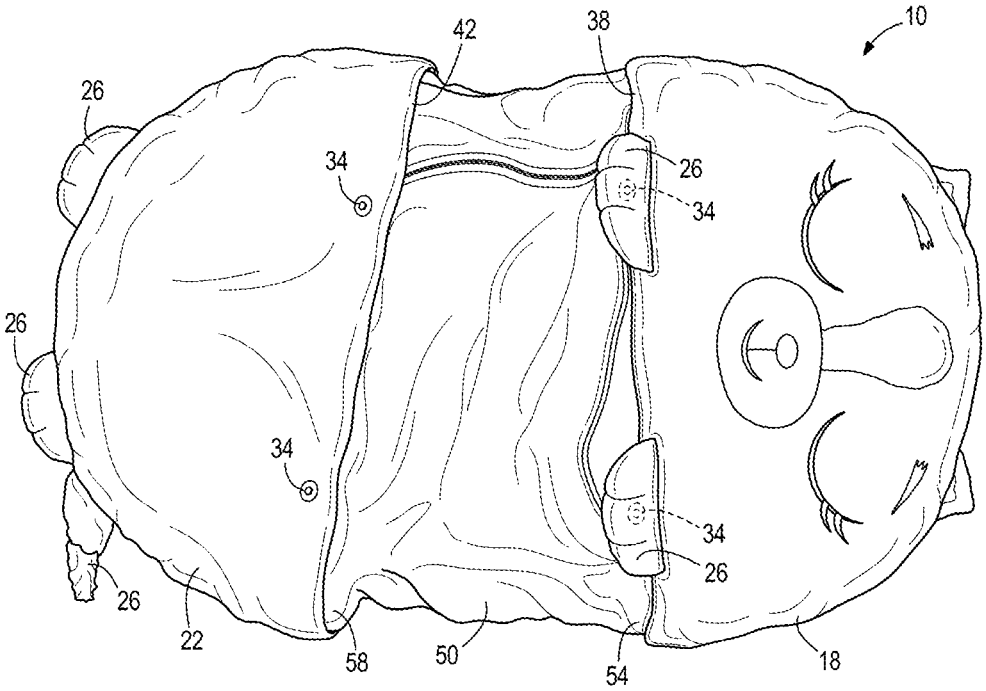
FIG. 9 depicts a front view of the combination pillow and sleeping bag of FIG. 1 transforming between the first configuration and a second configuration.
Figure 10:
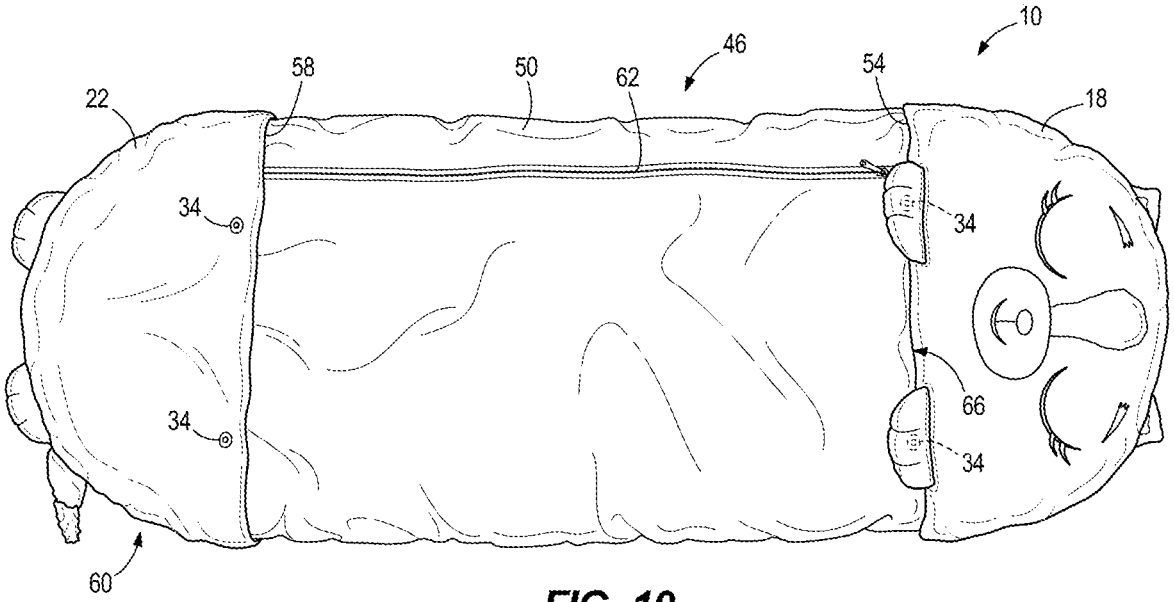
FIG. 10 depicts a front view of the combination pillow and sleeping bag of FIG. 1 in the second configuration.
Figure 11:
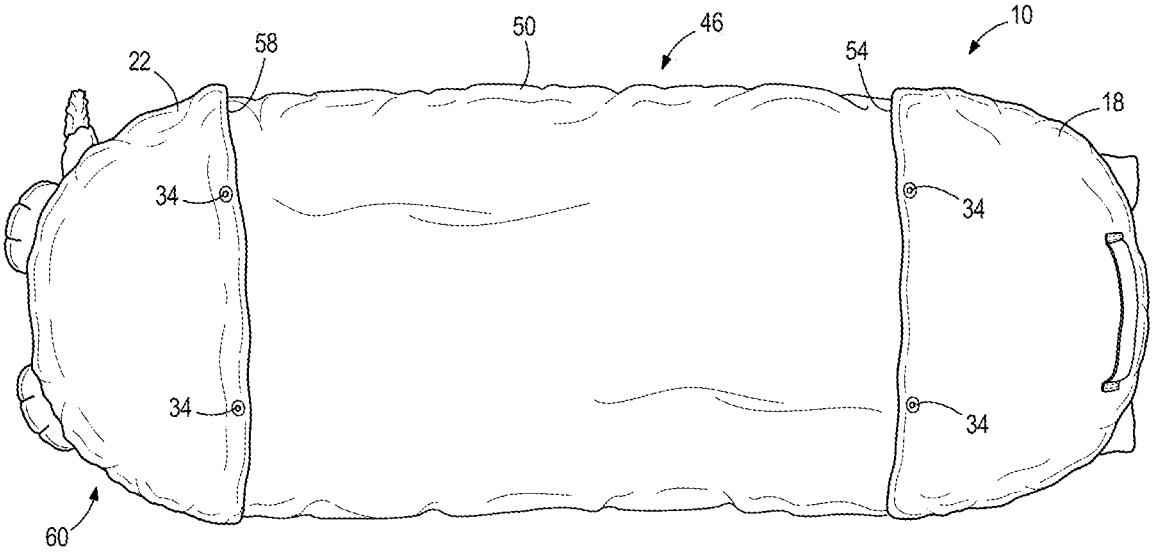
FIG. 11 depicts a rear view of the combination pillow and sleeping bag of FIG. 1 in the second configuration.

FIG. 9 depicts a front view of the example combination pillow and sleeping bag 10 during the transformation between the first configuration 14 and a second configuration 46 (see FIGS. 10 and 11). To convert the combination pillow and sleeping bag 10 from the first configuration 14 to the second configuration 46, the fasteners 34 are disconnected and a sleeping bag portion 50 is removed from the cavity 24 of the second pillow portion 22 by moving the first pillow portion 18 away from the second pillow portion 22 until the sleeping bag portion 50 is fully extended between the two pillow portions 18, 22. To transform the combination pillow and sleeping bag 10 from the second configuration 46 to the first configuration 14, the sleeping bag 50 is gathered and placed within the cavity 24 of the second pillow portion 22 until the sleeping bag portion 50 is fully positioned within the cavity 24 of the second pillow portion 22. The fasteners 34 are then connected to attach the second pillow portion 22 to the first pillow portion 18.

FIGS. 10 and 11 depict the combination pillow and sleeping bag 10 in the second configuration 46, which is a sleeping bag with an attached pillow (e.g., first pillow portion 18 acts as a pillow for the user's head when the user is in the sleeping bag portion 50) in this example embodiment. The sleeping bag portion 50 has a first end 54 coupled to the first pillow portion 18 and a second end 58 coupled to the second pillow portion 22. When the combination pillow and sleeping bag 10 is in the second configuration 46, the first and second pillow portions 18, 22 are detached from one another and spaced apart such that the sleeping bag portion 50 extends between the first and second pillow portions 18, 22.

Figure 12:
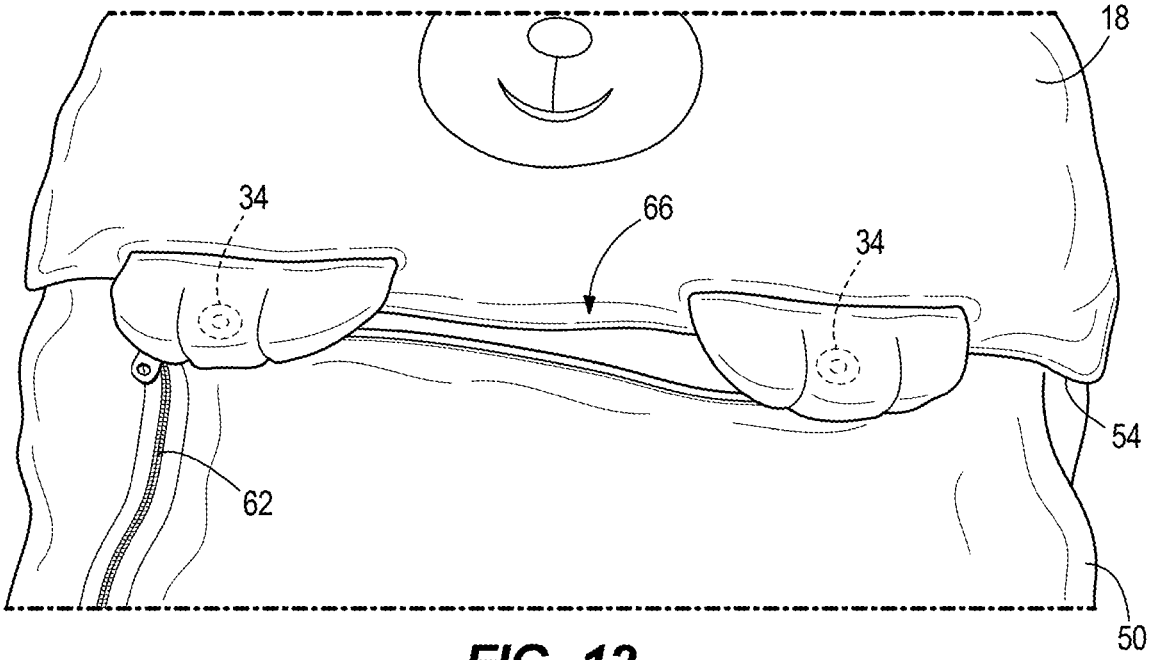
FIG. 12 is a detailed front view of the connection of a first end of the sleeping bag to the first pillow portion.
Figure 13:
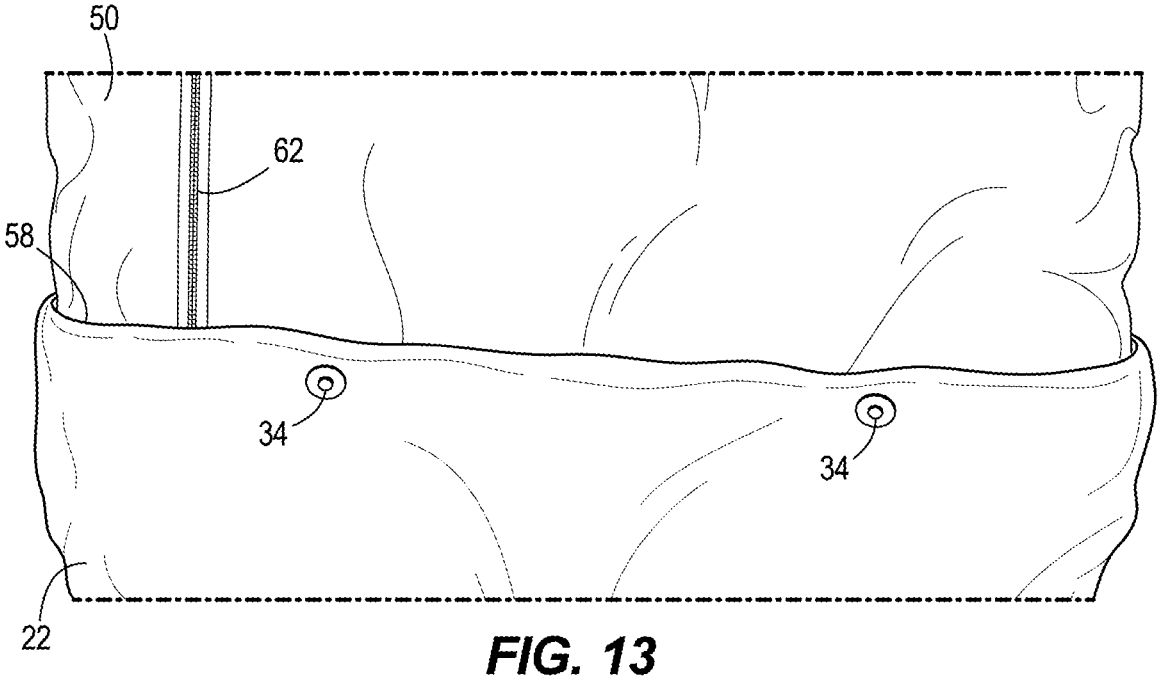
FIG. 13 is a detailed rear view of the connection of a second end of the sleeping bag to the second pillow portion.
Figure 14:
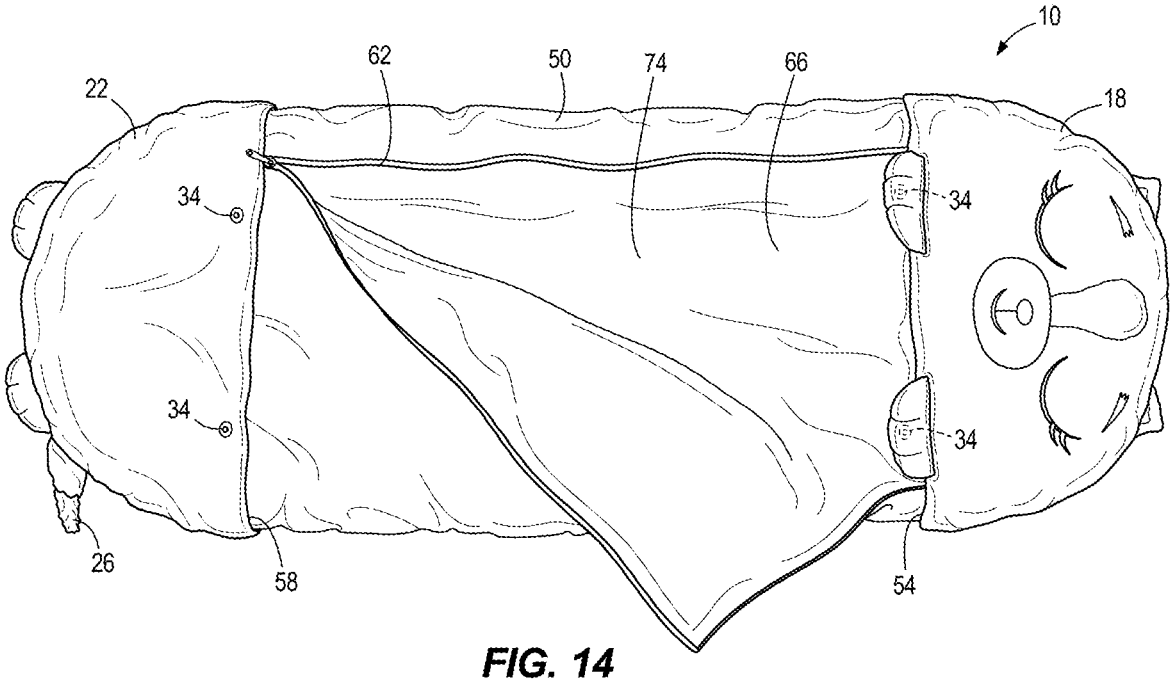
FIG. 14 depicts a front view of the combination pillow and sleeping bag of FIG. 1 in the second configuration with the sleeping bag in a partially open state.
Figure 15:
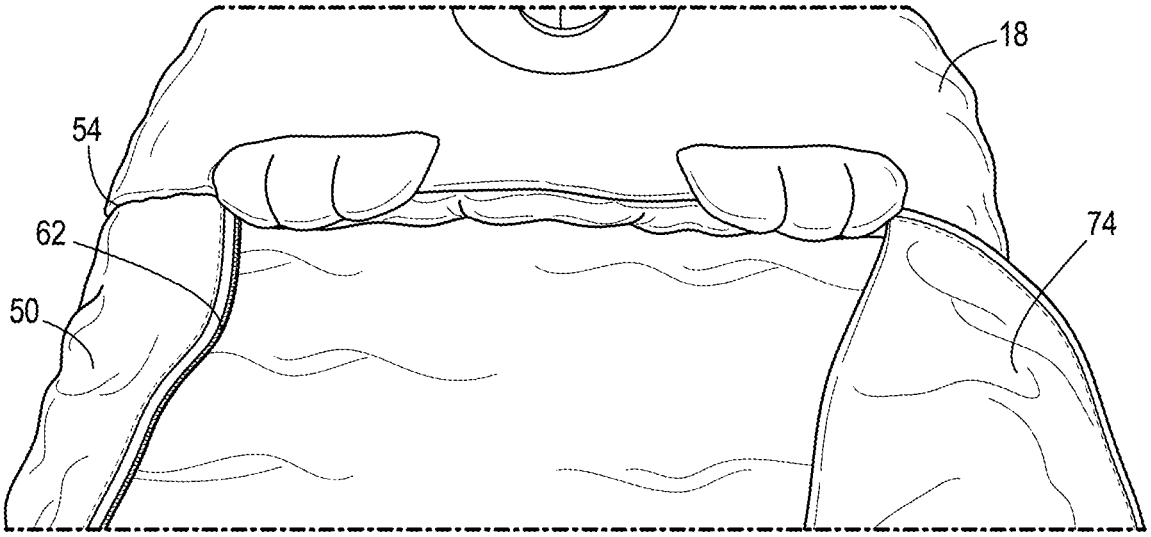
FIG. 15 is a detailed front perspective view of the connection of the first end of the sleeping bag to the first pillow portion with the sleeping bag in the partially open state.

As shown in FIGS. 12, 14, and 15, a portion of the first end 54 of the sleeping bag portion 50 is coupled to the first pillow portion 18 such that an unattached portion of the first end 54 of the sleeping bag portion 50 forms an opening 66 of the sleeping bag portion 50, adjacent to the first pillow portion 18, in the second configuration 46. In other words, the first end 54 of the generally tubular-shaped sleeping bag portion 50 is not attached around its entire perimeter to the first pillow portion 18, but instead remains unattached along a front portion of its perimeter to permit a user to access the interior of the sleeping bag portion 50 from the first end 54. The second end 58 of the sleeping bag portion 50 is coupled to the second pillow portion 22 around an entire perimeter of the second end 58 of the sleeping bag portion 50 such that the second pillow portion 22 cooperates/communicates with the sleeping bag portion 50 to form a closed end 60, as shown in FIGS. 10 and 11. As such, when a user is positioned within the sleeping bag portion 50, the user's feet may extend into the cavity 24 (shown in FIG. 16) of the second pillow portion 22 such that the second pillow portion 22 defines the closed bottom end 60 of the combination pillow and sleeping bag 10 in the second configuration 46. In the illustrated embodiment, an exterior of the sleeping bag portion 50 comprises a second fabric different from the first fabric. However, the second fabric may correspond to or relate to the first fabric so that the sleeping bag portion 50 further conveys or contributes to the overall image or appearance of the character image. For example, where the character image is a ladybug, the second fabric might be a red fabric with black dots.

As shown in FIGS. 10 and 14, the sleeping bag portion 50 includes a zipper 62, which extends in a direction along the length of the sleeping bag portion 50 between the first end 54 of the sleeping bag portion 50 and the second end 58 of the sleeping bag portion 50. The zipper 62 is operable to partially open the sleeping bag portion 50, as depicted in FIGS. 14 and 15. FIGS. 12 and 15 depict in more detail how a portion of the first end 54 is coupled to the first pillow portion 18. Therefore, when the zipper 62 is opened, even greater access to the interior of the sleeping bag portion 50 is provided adjacent the first end 54.

Figure 16:
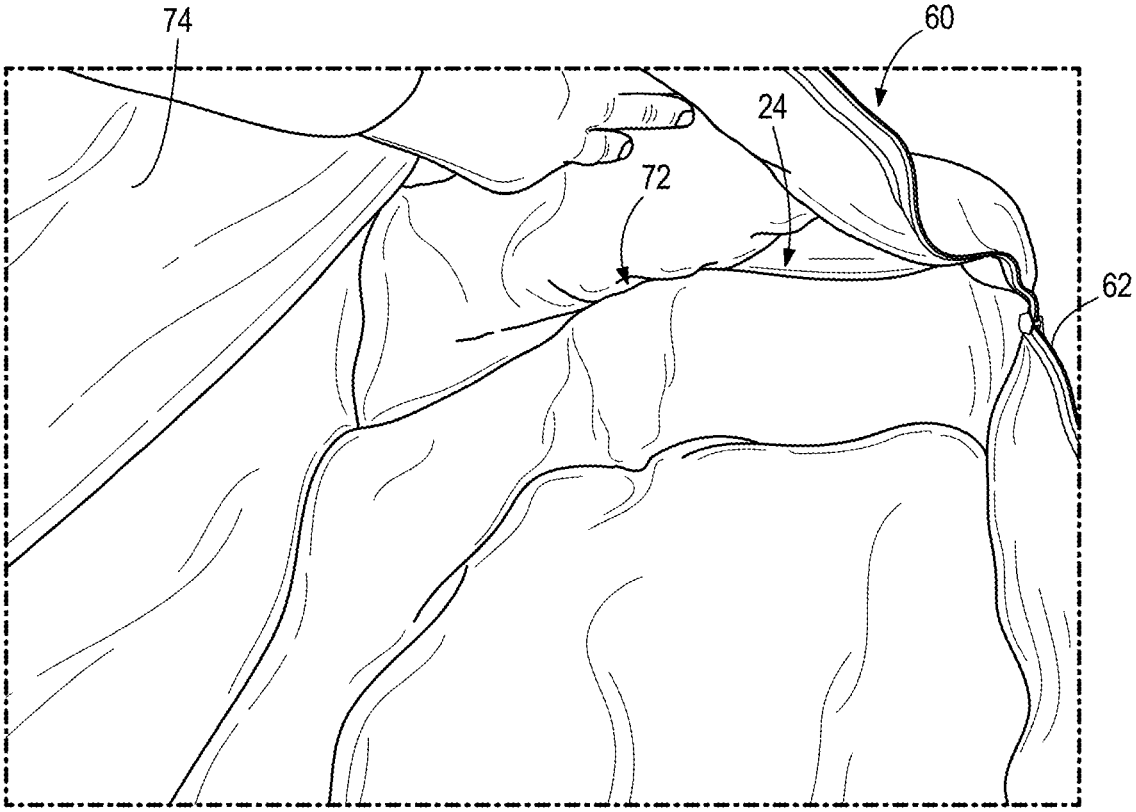
FIG. 16 is a detailed perspective view of an interior cavity of the second pillow portion with the combination pillow and sleeping bag of FIG. 1 in the second configuration.

As best shown in FIG. 16, an interior space 72 is formed by/within the sleeping bag portion 50 and is also at least partially formed by the cavity 24 of the second pillow portion 22. The interior space 72 includes and/or is defined by a liner 74 made of a third fabric. The third fabric may be selected to provide a comfortable and warm material for the interior space 72, and may have a coefficient of friction selected to facilitate a user entering and leaving the interior space 72. In the illustrated embodiment, the liner 74 extends the entire length of the sleeping bag portion 50 and into the cavity 24 of the second pillow portion 22. The interior space 72 is bound at one end (i.e., the lower end) by the closed end 60 formed by the second pillow portion 22 and the second end 58 of the sleeping bag portion 50. The interior space 72 is bound at the opposite end by the first end 54 of the sleeping bag portion 50 and the distal end 38 of the first pillow portion 18. In the illustrated embodiment, the interior space 72 does not extend into the first pillow portion 18.

The combination pillow and sleeping bag 10 provides a multi-functional item. In the first configuration 14, the pillow can be used to rest a user's head and also provides a soft pillow with a character image that resembles a plush toy or animal. In the second configuration 46, the sleeping bag portion 50 and second pillow portion 22 together define a sleeping bag in which a user can rest. The first pillow portion 18 serves as a pillow on which the user's head will rest when lying in the sleeping bag. Unlike many existing pillow and sleeping bag combinations, having only a single pillow portion, the illustrated second pillow portion 22, with its cavity 24, provides the storage for the sleeping bag portion 50, such that the first pillow portion 18 maintains its generally fixed shape in both the first and second configurations 14, 26. This can eliminate the need for the user requiring a separate/additional pillow when lying in the sleeping bag.

Figure 17:
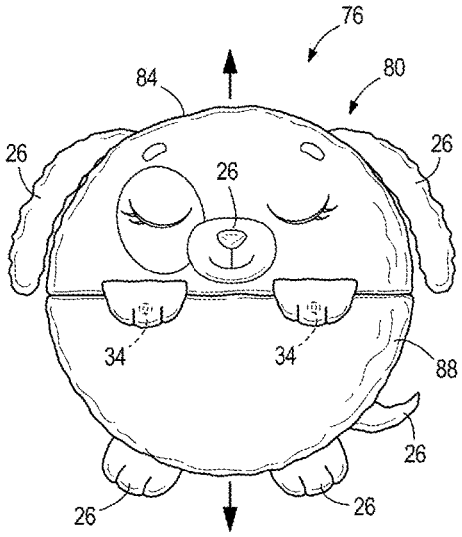
FIG. 17 depicts a front view of an example combination pillow and blanket in a first configuration.

FIG. 17 depicts a front view of an example combination pillow and blanket 76 in a first configuration 80. When in the first configuration 80, the combination pillow and blanket 76 is similar to the example combination pillow and sleeping bag 10 shown in FIG. 1. Thus, many of the same features (i.e., appendages 26, fasteners 34, carrying strap 30, etc.) may be included on the combination pillow and blanket 76, and the size and shape of the pillow created when the combination pillow and blanket 76 is in the first configuration may also be similar. This example combination pillow and blanket 76 depicts an alternative character image that may be used. Additionally, a first pillow portion 84 may be filled with one or more of a foam, a fiber stuffing, or beans, or any other suitable filling for a pillow. A second pillow portion 88 may include a cavity 92 (see FIG. 18) in which a blanket 96 is arranged when the combination pillow and blanket 76 is in the first configuration 80.

Figure 18:
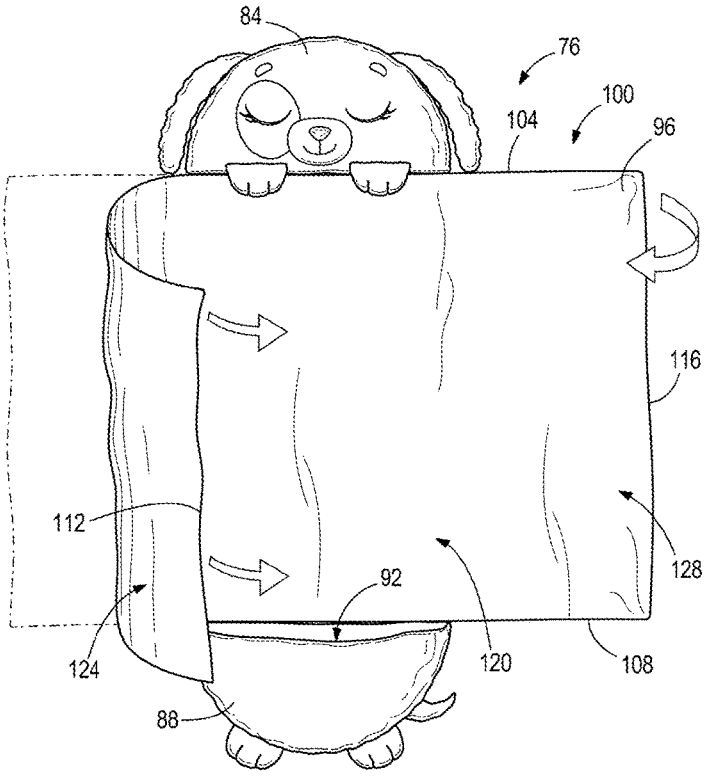
FIG. 18 depicts a front view of the combination pillow and blanket of FIG. 17 in a second configuration.
Figure 20:
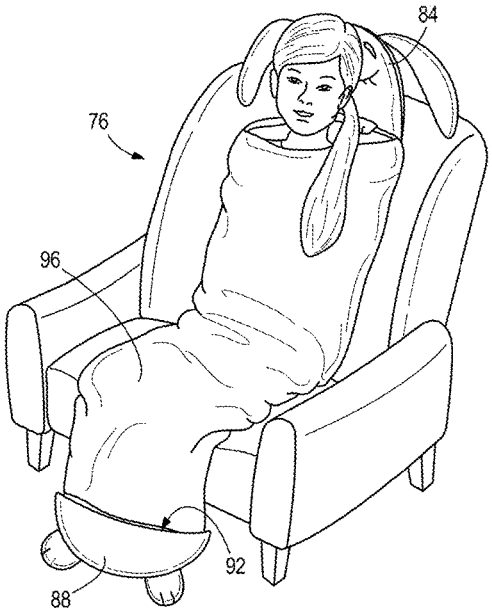
FIG. 20 depicts an example combination pillow and blanket in use.

FIG. 18 depicts a front view of the example combination pillow and blanket 76 in the second configuration 100. In the second configuration 100 the blanket 96 extends between the first and second pillow portions 84, 88. The illustrated blanket 96 has four edges 104, 108, 112, and 116, which form a perimeter of the blanket portion 96. The illustrated first and second edges 104, 108 are the opposite upper and lower edges as shown in FIG. 18, and a portion or section of each of the first and second edges 104, 108 is attached to the first and second pillow portions 84, 88, respectively. The edges 104, 108 or a portion of each of the edges 104, 108 can be stitched (permanently) or otherwise fastened (permanently or temporarily, e.g., with buttons, snaps, hook-and-loop fasteners, etc.) to the respective pillow portions 84, 88. The edges 104, 108 of the blanket 96 might be removably connected to the pillow portions 84, 88 to enable removal of the blanket 96 from the pillow portions 84, 88 for separate washing of the blanket 96. The illustrated third and fourth edges 112, 116 are the opposite left and right edges as shown in FIG. 18, and are not connected directly to the first or second pillow portions 84, 88. They are configured as free edges to fold over one another to wrap around a user as illustrated by the arrows in FIG. 18, and as shown in FIG. 20. The blanket may be considered to be divided into a back or center portion 120 aligned with and extending generally between the two pillow portions 84, 88, and two side portions 124, 128, which are foldable to overlap in front of the back portion 120. Overlapping the side portions 124, 128 creates a tubular, sack-like structure for surrounding or wrapping-around a person using the blanket 96. As described above, the second pillow portion 88 defines a cavity 92 into which the blanket 96 can be folded and/or positioned when the combination pillow and blanket 76 is in the first configuration 80. Fasteners may be used to secure the first pillow portion 84 to the second pillow portion 88.

The blanket 96 may be made from a soft fabric that is different from the fabric used for the first and second pillow portions 84, 88. For example, the fabric may be fleece, cotton, flannel, a polyester blend, etc. The fabric of the blanket 96 may include a print or pattern that corresponds to the character image created by the first and second pillow portions 84, 88. For example, the fabric may include similar colors as used in the character image or may be related to the character image in some way. The size and shape of the blanket can vary as desired. For example, the blanket could have more than four edges, perhaps being shaped as a hexagon (or another polygonal shape). As long as at least a section of one edge of the blanket 96 is connected/connectable to the first pillow portion 84 and at least a section of another edge of the blanket 96 is connected/connectable to the second pillow portion 88, the size and shape of the blanket 96 can vary. Alternatively, the blanket 96 may be round or oval-shaped. In such examples, the blanket may be attached to the first and second pillow portions 84, 88 at two opposing sections of the perimeter of the blanket 96. Additional opposing sections are included in the remainder of the perimeter. The additional opposing sections may be folded over one another to wrap around a user.

Figure 19:
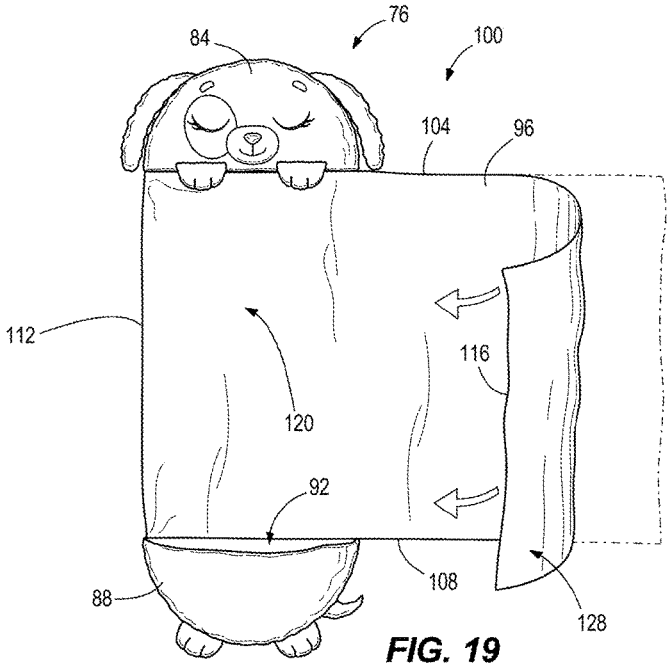
FIG. 19 depicts a front view of another example combination pillow and blanket in a second configuration.

FIG. 19 depicts another example embodiment of the combination pillow and blanket 76. This embodiment is identical to that described above, except the blanket 96 is not centered relative to the first and second pillow portions 84, 88. Instead, the third edge 112 may be generally aligned with the respective sides of the first and second pillow portions 84, 88 such that the third edge 112 does not fold over. In this embodiment, only the fourth edge 116 folds over to wrap around a user as illustrated by the arrows in FIG. 19, and as shown in FIG. 20. This embodiment, therefore, may be considered to be divided into a back portion 120 aligned with and generally extending between the two pillow portions 84, 88, and a single side portion 128, which is foldable to overlap in front of the back portion 120.

FIG. 20 depicts the example combination pillow and blanket 76 in use. As shown in FIG. 20, the blanket portion 96 wraps around the user. The first pillow portion 84 is still useable as a pillow, and the second pillow portion 88 provides the cavity 92 into which the user may place their feet.

In some examples, the combination pillow and sleeping bag 10 discussed above may include a zipper that may completely unzip from top to bottom such that the sleeping bag portion 50 may transform into a blanket 96. The zipper could be centrally located such that when unzipped, the two side portions created would be substantially the same size, although this need not be the case. In such examples, a section of the bottom edge of the sleeping bag portion 50 may be connected to the second pillow portion 22, or the second pillow portion 22 may also include a zipper or other additional fasteners to allow the sleeping bag portion 50 to partially detach from the second pillow portion 22, or to allow the second pillow portion 22 to partially open. In a somewhat similar example, the combination pillow and blanket 76 may include zippers on the third and fourth edges 112, 116 that allow the edges 112, 116 to zip together to form a sleeping bag 50. Other fasteners or zippers may be used to more completely connect the second pillow portion 22, 88 to the second edge 108 of the blanket 96. Thus, a combination pillow and sleeping bag or blanket may be convertible between a pillow, a blanket, and a sleeping bag.

Figure 21:
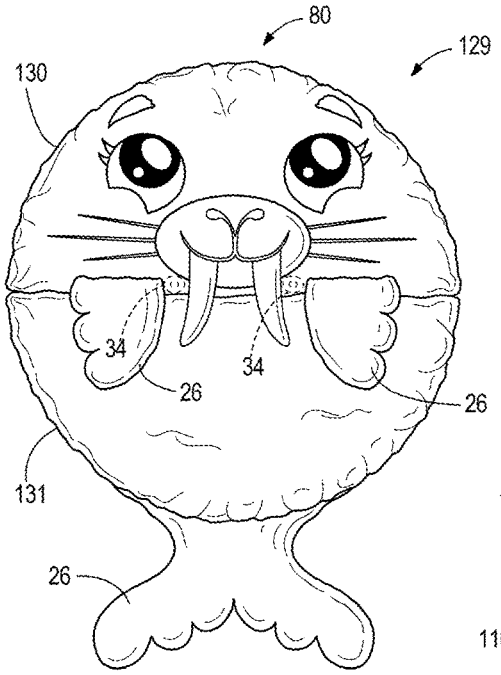
FIG. 21 depicts a front view of another example combination pillow and blanket in a first configuration.

FIG. 21 depicts another example combination pillow and blanket 129. This embodiment depicts an alternative character image that may be used. Many features of the combination pillow and blanket 129 are similar to those of the combination pillow and blanket 76 discussed above, such as the inclusion of a blanket 96 having four edges 104, 108, 112, 116, appendages 26, fasteners 34, carrying strap 30, etc. The size and shape of the pillow created when the combination pillow and blanket 129 is in the first configuration 80 may also be similar.

Figure 22:
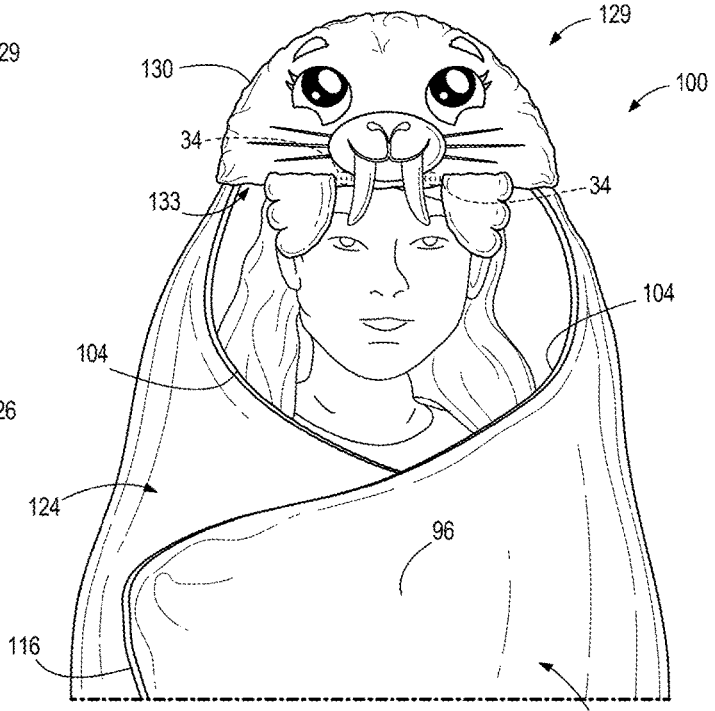
FIG. 22 depicts a detailed perspective view of the combination pillow and blanket of FIG. 21 in use.
Figure 23:
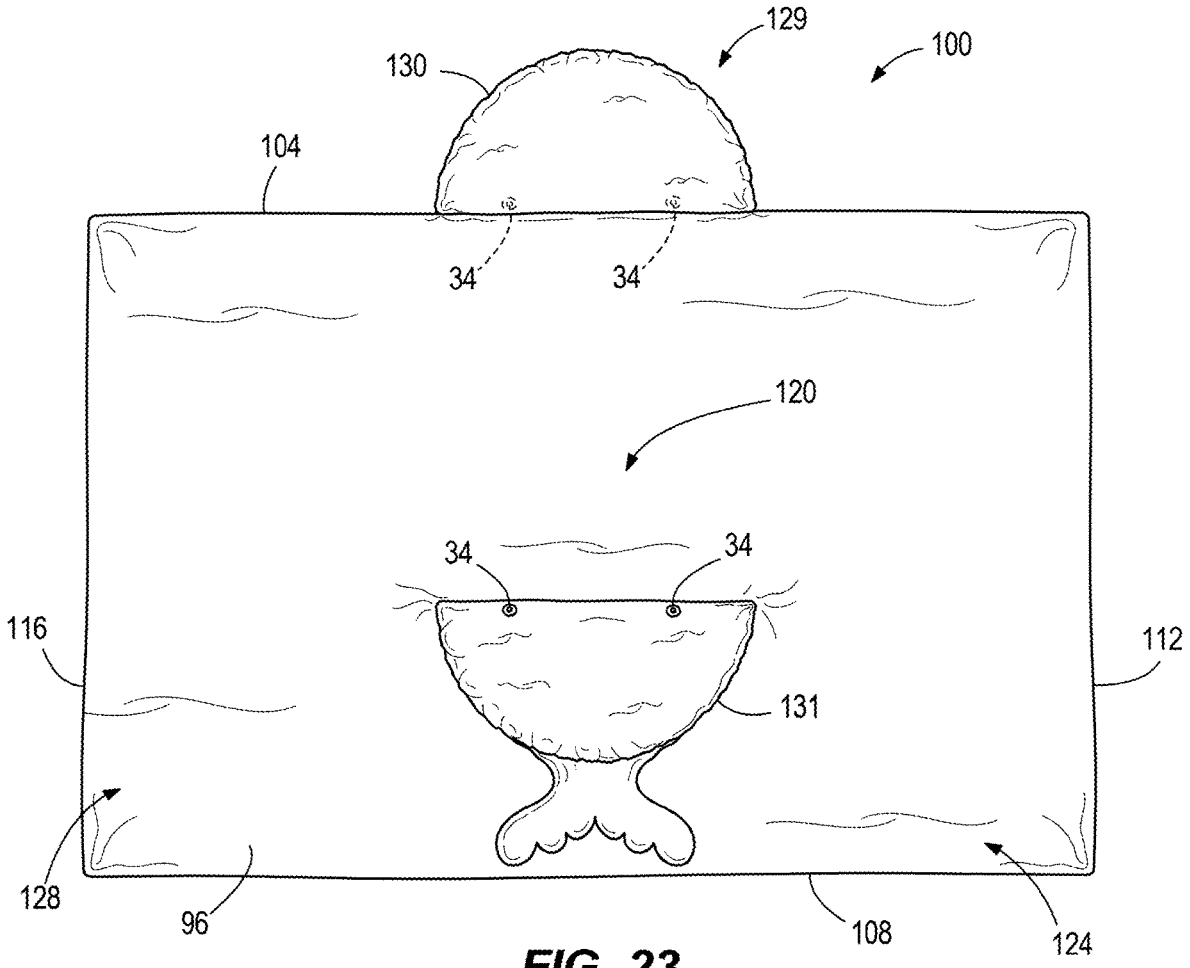
FIG. 23 depicts a rear view of the combination pillow and blanket of FIG. 21 in a second configuration.

The combination pillow and blanket 129 includes a first portion 130 and a second portion 131. The first and second portions 130, 131 may be similar to the first and second pillow portions 84, 88 discussed above, or the first and second portions 130, 131 may be different in that they may not include any stuffing. Further, the first portion 130 may be provided with a cavity 133 such that the first portion 130 functions as a hood for a user to wear with the combination pillow and blanket 129 in the second configuration 100 (as shown in FIG. 22). In this sense, the first and second portions 130, 131 are not used as pillows in the second configuration 100, but the first and second portions 130, 131 cooperate to form a pillow in the first configuration 80. As shown in FIGS. 21-23, fasteners 34 on the first portion 130 are provided on an interior surface within the cavity 133 of the hood.

While in the first configuration 80, the blanket 96 may be stored in one or both of the first and second portions 130, 131. In some embodiments, the blanket 96 itself functions as some or all of the padding for the combination pillow and blanket 129 to function as a pillow in the first configuration 80.

The first and second portions 130, 131 may be coupled to the blanket 96 in any of the ways mentioned above. In the illustrated embodiment shown in FIG. 23, the first and second portions 130, 131 are permanently fastened to the blanket 96 with stitching. The first portion 130 is coupled to a portion or section of the first edge 104 of the blanket 96, but the first portion 130 may be coupled to the blanket 96 in other alternative places. The second portion 131 is coupled to the blanket 96 a distance away from the first portion 130. In the illustrated embodiment, the second portion 131 is coupled to a center portion 120 of the blanket 96. Other embodiments, however, may include the second portion 131 coupled to the blanket 96 in other locations, such as the second edge 108, for instance. In the illustrated example of FIG. 23, the second portion 131 is coupled to the blanket 96 on a back side of the blanket 96.

Figure 24:
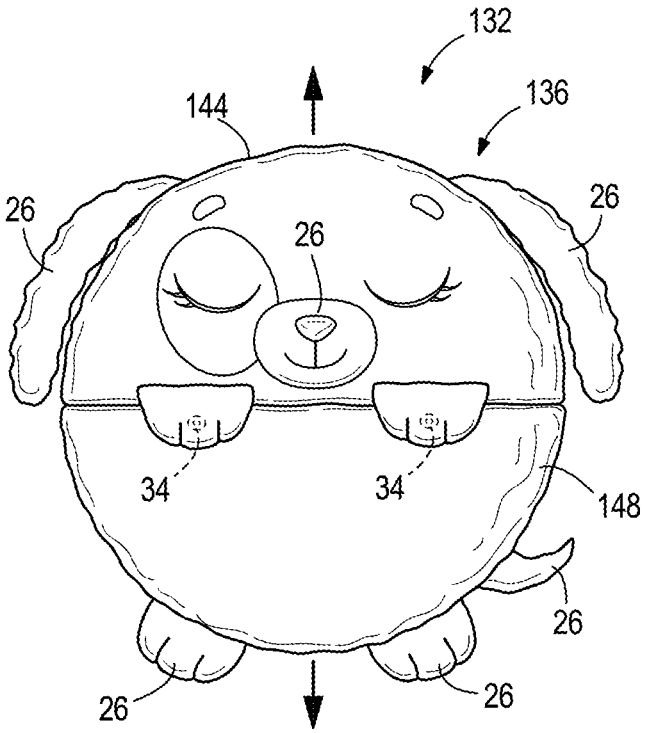
FIG. 24 depicts a front view of an example combination pillow and comforter in a first configuration.

FIG. 24 depicts a front view of an example combination pillow and comforter 132 in a first configuration 136. When in the first configuration 136, the combination pillow and comforter 132 is similar to the example combination pillow and sleeping bag 10 shown in FIG. 1. Thus, many of the same features (i.e., appendages 26, fasteners 34, etc.) may be included on the combination pillow and comforter 132, and the size and shape of the pillow created when the combination pillow and comforter 132 is in the first configuration may also be similar to the example combination pillow and sleeping bag 10 shown in FIG. 1. Alternatively, the size of the combination pillow and comforter may be larger (e.g., approximately 30 inches in diameter) to accommodate the size of the comforter portion 140 (shown in FIGS. 25 and 26). This example combination pillow and comforter 132 depicts a character image that may be used. Additionally, a first pillow portion 144 may be filled with one or more of a foam, a fiber stuffing, or beans, or any other suitable filling for a pillow. A second pillow portion 148 may include a cavity in which the comforter 140 is arranged when the combination pillow and comforter 132 is in the first configuration 136. Fasteners may be used to secure the first pillow portion 144 to the second pillow portion 148.

Figure 25:
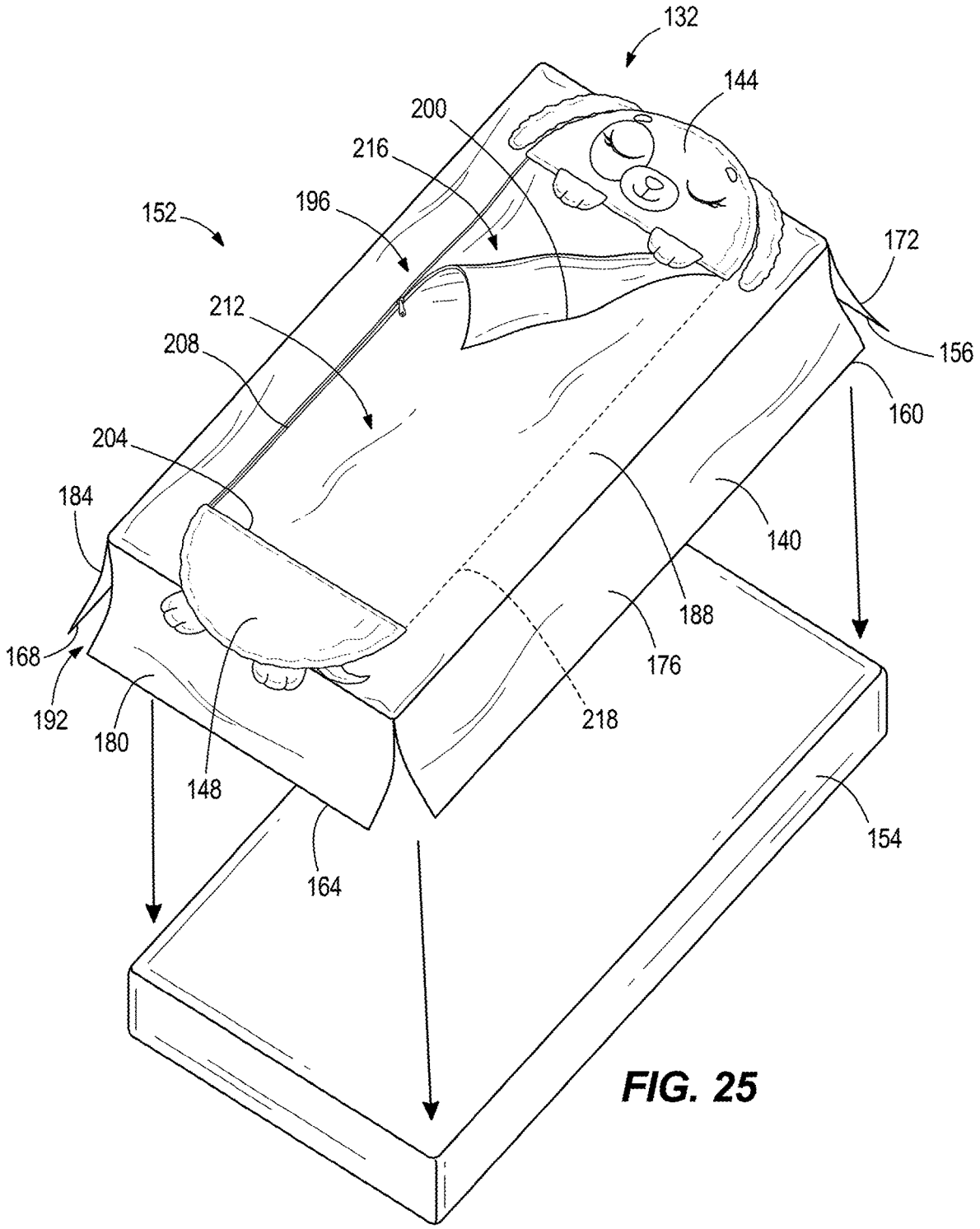
FIG. 25 depicts a perspective view of the combination pillow and comforter of FIG. 24 in a second configuration positioned to be placed on a mattress.
Figure 26:
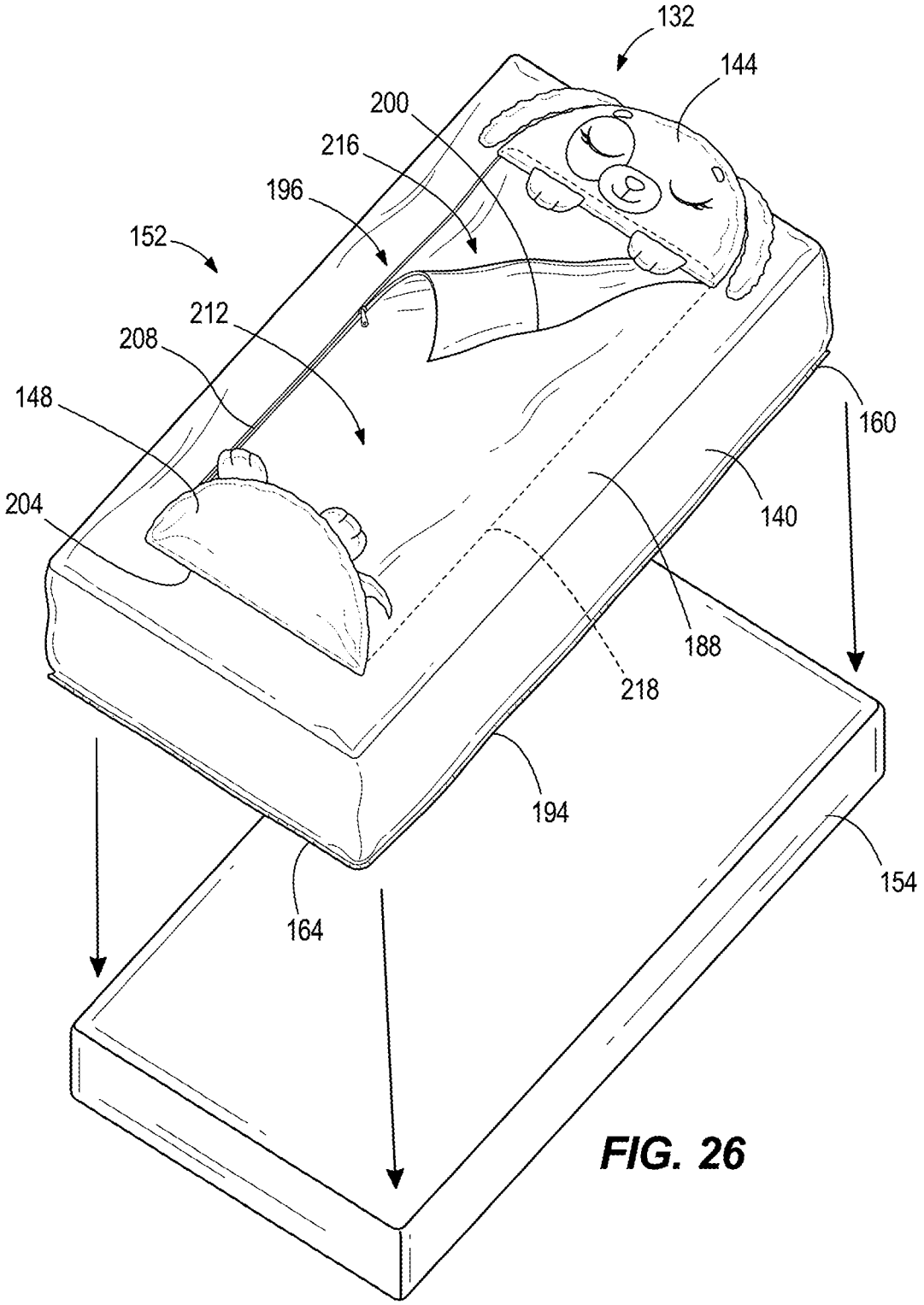
FIG. 26 depicts a perspective view of another example combination pillow and comforter in a second configuration positioned to be placed on a mattress.

FIG. 25 depicts a front view of the example combination pillow and comforter 132 in a second configuration 152. In the second configuration 152, the comforter 140 defines an outer periphery that is generally rectangular such that the comforter 140 fits over a mattress 154 (e.g., a twin mattress). When in the second configuration, the first and second pillow portions 144, 148 are positioned at least partially or entirely within the outer periphery of the comforter. The illustrated comforter 140 has four edges 156, 160, 164, 168, which generally form the periphery of the comforter portion 140. The example comforter 140 may be generally rectangular shaped to correspond to a size and shape of a mattress, such as a twin mattress. However, other shapes and sizes of the comforter 140 may be used instead. The periphery of the example comforter 140 is partially formed by sides or flaps 172, 176, 180, and 184 extending downward from a central surface 188 of the comforter 140 to fit around the sides of the mattress. The sides are partially defined by slits 192 at each corner of the comforter 140. The exemplary central surface 188 is the portion of the comforter 140 that lies on the upper surface of a mattress 154. In alternative examples, such as the one shown in FIG. 26, the corners may be defined using elastic 194 such that the corners of the comforter 140 are fitted to the corners of a mattress 154, similar to a fitted sheet. The elastic 194 may be located about each of the corners, but may additionally be located about the entire perimeter of the comforter 140, such that the elastic 194 is located at each of the edges 156, 160, 164, 168. Alternatively, the comforter 140 is essentially a single plane that is wide and long enough to hang over the edges and corners of a twin mattress 154.

The first and second pillow portions 144, 148 may be attached to the central surface 188 such that when the combination pillow and comforter 132 is in the second configuration 152, the first and second pillow portions 144, 148 are at opposing sides (e.g., the top and bottom) of the mattress, respectively. The first and second pillow portions 144, 148 are generally centered along the width of the comforter 140. The first and second pillow portions 144, 148 are each coupled to a portion of the central surface 188 of the comforter on a back side of each pillow portion such that the front side of each pillow portion is on top of the comforter 140. The first and second pillow portions 144, 148 can be stitched (permanently) or otherwise fastened (permanently or temporarily, e.g., with buttons, snaps, hook-and-loop fasteners, etc.) to the comforter 140. The first and second pillow portions 144, 148 might be removably connected to the comforter 140 to enable removal of the comforter 140 from the pillow portions 144, 148 for separate washing of the comforter 140.

Additionally, a sleeping bag 196 may be positioned between the first and second pillow 144, 148 portions on top of the comforter 140. In some examples, the sleeping bag 196 is sewn into the center or near the center of the comforter 140. For example, an opening may be cut into the center of the comforter 140, and the sleeping bag 196 may be inserted into the opening and sewn to edges of the opening so that the sleeping bag 196 is positioned between the first and second pillow portions 144, 148. The sleeping bag has a first end 200 that is adjacent to, but not connected to, the first pillow portion 144 that partially forms the opening of the sleeping bag 196. A second end 204 of the sleeping bag is attached to a top side of the second pillow portion 148 such that a cavity is formed within the second pillow portion 148 for a user's feet. A zipper 208 extends between the first and second ends 200, 204 to further open the sleeping bag 196 and enable the user to enter and exit the sleeping bag 196. The fabric of an exterior 212 of the sleeping bag is the same as the fabric of the comforter to create a uniform look of the comforter. A second fabric may be used on the interior 216 of the sleeping bag that corresponds to the exterior fabric. In other examples, the sleeping bag 196 is sewn on top of the comforter 140.

Alternatively, the sleeping bag 196 may be formed by adding an additional layer or layers of fabric to the central surface 188 in the area between the first and second pillow portions 144, 148. For example, in the area between the first and second pillow portions 144, 148, an additional layer of fabric that matches the comforter 140 may be sewn to the bottom pillow portion 148 and along an edge 218 of the sleeping bag portion 196 extending in a direction between the first and second portions 144, 148. A zipper 208 is then attached to a second edge of the sleeping bag between the first and second pillow portions 144, 148. In another alternative example, a top layer of the comforter 140 may be partially cut into an opening such that sides of the top layer of the comforter 140 adjacent to the top and bottom pillow portions 144, 148, and an edge extending between the first and second pillow portion form three edges of the sleeping bag. A liner may then be sewn to these edges to form a sleeping bag within and/or between layers of the comforter. The bottom edge may be sewn to the bottom pillow portion 144, a zipper is sewn to the side edge so that the side edge may be connected to the comforter portion, and the top edge is finished to so that the top edge forms the top opening of the sleeping bag.

Although the invention has been described in detail with reference to certain preferred embodiments, variations and modifications exist within the scope and spirit of one or more independent aspects of the invention as described.

What is claimed is:

1. A combination pillow and sleeping bag configurable between a first configuration and a second configuration, the combination pillow and sleeping bag comprising:

a first pillow portion;

a second pillow portion detachably coupled to the first pillow portion, the second pillow portion defining a cavity; and a sleeping bag having a first end coupled to the first pillow portion and a second end coupled to the second pillow portion;

wherein in the first configuration, the first and second pillow portions are coupled together and the sleeping bag is positioned within the cavity of the second pillow portion;

wherein in the second configuration, the first and second pillow portions are detached from one another and spaced apart such that the sleeping bag extends between the first and second pillow portions; and wherein the second end of the sleeping bag is coupled to the second pillow portion around an entire perimeter of the second end of the sleeping bag such that the second pillow portion cooperates with the sleeping bag to form a closed end.

2. The combination pillow and sleeping bag of claim 1, further comprising at least one fastener, wherein the at least one fastener detachably couples the first pillow portion to the second pillow portion.

3. The combination pillow and sleeping bag of claim 1, wherein the first end of the sleeping bag is coupled to the first pillow portion such that an unattached portion of the first end of the sleeping bag forms an opening into an interior space of the sleeping bag in the second configuration.

4. The combination pillow and sleeping bag of claim 1, further including a zipper, wherein the zipper extends in a direction between the first end of the sleeping bag and the second end of the sleeping bag.

5. The combination pillow and sleeping bag of claim 1, wherein exteriors of the first and second pillow portions comprise a first fabric, and an exterior of the sleeping bag comprises a second fabric different from the first fabric.

6. The combination pillow and sleeping bag of claim 5, wherein the sleeping bag includes a liner made of a third fabric, the liner extending into the cavity of the second pillow portion.

7. The combination pillow and sleeping bag of claim 1, wherein in the first configuration, the first and second pillow portions cooperate to form a pillow having a generally continuous outer periphery.

8. The combination pillow and sleeping bag of claim 1, wherein a character image is formed by the coupled first and second pillow portions when the combination pillow and sleeping bag is in the first configuration.

9. The combination pillow and sleeping bag of claim 8, further comprising appendages attached to the first and second pillow portions, the appendages corresponding to the character image.

10. The combination pillow and sleeping bag of claim 1, further including a carrying strap on one of the first pillow portion or the second pillow portion.

11. The combination pillow and sleeping bag of claim 1, wherein the first pillow portion is filled with one of a foam, a fiber stuffing, or beans.

12. The combination pillow and sleeping bag of claim 1, wherein each of the first and second pillow portions is approximately the same size and shape in the first configuration.

13. The combination pillow and sleeping bag of claim 12, wherein each of the first and second pillow portions is generally semi-circular in shape.

14. A combination pillow and sleeping bag configurable between a first configuration and a second configuration, the combination pillow and sleeping bag comprising:

a first pillow portion containing a stuffing material that gives the first pillow portion a generally fixed shape;

a second pillow portion detachably coupled to the first pillow portion, the second pillow portion defining a cavity;

a fastener on one of the first or second pillow portions for detachably coupling the first and second pillow portions together; and a sleeping bag having a first end coupled to the first pillow portion and a second end coupled to the second pillow portion;

wherein in the first configuration, the first and second pillow portions are detachably coupled together by the fastener with the sleeping bag positioned within the cavity of the second pillow portion, the sleeping bag acting as stuffing material for the second pillow portion, wherein the portion of the sleeping bag positioned within the cavity of the second pillow portion gives the second pillow portion a generally fixed shape; and wherein in the second configuration, the first and second pillow portions are detached from one another and spaced apart such that the sleeping bag extends between the first and second pillow portions, the second end of the sleeping bag being coupled to the second pillow portion around an entire perimeter of the second end of the sleeping bag such that the second pillow portion cooperates with the sleeping bag to form a closed end, and wherein the sleeping bag is coupled to the first pillow portion around less than an entire perimeter of the first end of the sleeping bag such that an unattached portion of the first end of the sleeping bag forms an opening into an interior space of the sleeping bag in the second configuration.

15. The combination pillow and sleeping bag of claim 14, further comprising a zipper extending along the sleeping bag between the first end and the second end.

16. The combination pillow and sleeping bag of claim 14, wherein the fastener is coupled to an appendage on the respective pillow portion.

17. The combination pillow and sleeping bag of claim 14, wherein exteriors of the first and second pillow portions comprise a first fabric, and an exterior of the sleeping bag comprises a second fabric different from the first fabric.

18. The combination pillow and sleeping bag of claim 17, wherein the sleeping bag includes a liner made of a third fabric, the liner extending into the cavity of the second pillow portion.

* * * * *